US005534173A

United States Patent [19]

Faber et al.

[11] Patent Number: 5,534,173

[45] Date of Patent: Jul. 9, 1996

[54] LIGHT DUTY LUBRICANT COMPOSITION AND METHOD OF USE

[75] Inventors: Robert D. Faber, Grand Rapids; Ronald C. Jackson, Wyoming, both of Mich.

[73] Assignee: Amway Corporation, Ada, Mich.

[21] Appl. No.: 298,241

[22] Filed: Aug. 30, 1994

[51] Int. Cl.[6] ..... C10M 105/76

[52] U.S. Cl. ..... 508/203

[58] Field of Search ..... 252/49.6, 56 R

[56] References Cited

U.S. PATENT DOCUMENTS

| | | | |
|---|---|---|---|
| 3,269,949 | 8/1966 | Borg . | |
| 3,312,306 | 4/1967 | Carlston et al. . | |
| 3,468,688 | 9/1969 | Mitacek et al. . | |
| 3,578,596 | 5/1971 | Conway . | |
| 3,759,827 | 9/1973 | Groenhof et al. . | |
| 3,791,488 | 2/1974 | Rowe et al. . | |
| 3,928,218 | 12/1975 | Rowe et al. | 252/49.6 |
| 3,981,810 | 9/1976 | Bolster . | |
| 4,059,534 | 11/1977 | Morro et al. . | |
| 4,115,343 | 9/1978 | Guillaume | 252/49.6 |
| 4,171,267 | 11/1979 | McAfee et al. . | |
| 4,190,546 | 2/1980 | Kulik et al. | 252/49.6 |
| 4,248,724 | 3/1981 | MacIntosh | 252/49.6 |
| 4,405,469 | 9/1983 | Hafner et al. . | |
| 4,443,348 | 4/1984 | Wright et al. . | |
| 4,652,386 | 3/1987 | Alberts et al. . | |
| 4,719,024 | 1/1988 | Speier et al. . | |
| 5,149,450 | 9/1992 | Konigs . | |
| 5,326,387 | 7/1994 | Faber et al. . | |

*Primary Examiner*—Jacqueline V. Howard
*Attorney, Agent, or Firm*—Amway Corporation

[57] ABSTRACT

Light duty lubricant compositions containing volatile silicones are prepared which when applied to metal surfaces show improved penetration and spreadability. Preferably, the composition includes a volatile silicone fluid, a hydrocarbon solvent such as mineral spirits, a lubricating oil soluble in a hydrocarbon base such as hydrocarbon oils and optionally a corrosion inhibitor such as petroleum oxidates. An aerosol propellant is contained in one preferred embodiment of the light duty lubricant composition. In an additional preferred embodiment, a method of freeing frozen or corroded parts with a light duty lubricant composition is disclosed.

20 Claims, No Drawings

LIGHT DUTY LUBRICANT COMPOSITION AND METHOD OF USE

BACKGROUND OF THE INVENTION

The present invention relates to light duty lubricant compositions. More particularly, the present invention is directed to light duty lubricant compositions containing volatile silicones, which compositions show enhanced spreading and penetration characteristics. A method for using light duty lubricant compositions is also disclosed.

Light duty lubricants are known in the art and have traditionally employed various types of components such as mineral oils, organic solvents, and in some instances silicone oils. Typically, these lubricants are applied to various surfaces through spraying, brushing or dipping and the lubricant thereafter spreads or flows on the surface area while also penetrating into any corroded parts. These lubricants are limited by the penetrating, spreading or leveling performance that they exhibit on treated materials. In the composition of the present invention, it has been surprisingly found that the addition of relatively low levels of volatile silicone fluid to various types of hydrocarbon-based lubricant compositions creates a lubrication system which shows properties of improved penetration and spreadability. Additionally, these enhanced properties create a system which can be easily and evenly applied to metal and non-metal surfaces through methods of spraying, brushing or rolling the lubricant onto the surface area and additionally by dipping the part into the light duty lubricant composition.

SUMMARY OF THE INVENTION

In a first embodiment, the present invention discloses a light duty lubricant composition with enhanced penetration and spreadability comprising:

(a) from about 30% to about 97% of a hydrocarbon solvent such as mineral spirits;

(b) from about 1% to about 30% of a volatile silicone such as polydimethylcyclosiloxane and mixtures thereof; and (c) from about 1% to about 30% of a lubricating oil soluble in a hydrocarbon base such as hydrocarbon oils and mixtures thereof.

In a second embodiment, the light duty lubricant further comprises from about 1% to about 10% of a corrosion inhibitor such as fatty or petroleum oxidates and mixtures thereof.

In another embodiment, the light duty lubricant composition comprising a hydrocarbon solvent, a volatile silicone, a lubricating oil and a corrosion inhibitor is blended with an aerosol propellant in the range of from about 50% to 99% of lubricant composition to about 1% to 50% of aerosol propellant.

In another embodiment, a method of freeing frozen or corroded parts with a light duty lubricant composition is disclosed comprising the steps of applying the lubricant composition to the frozen or corroded part, waiting a sufficient period of time for the lubricant to seep into the frozen or corroded part and applying appropriate force to free the corroded part.

In the light duty lubricant composition of the present invention, it has been surprisingly found that the addition of volatile silicone fluids, such as polydimethylcyclosiloxanes, into a light duty lubricant system enhances film properties and improves penetration and spreadability of the lubricant system. The light duty lubricant composition of the present invention also shows surprisingly exceptional rust prevention which is believed to be a result of the enhanced film properties which accentuate the performance of the corrosion inhibitor.

In the description that follows, it is to be assumed that all percentages are based on the total weight of the composition.

DETAILED DESCRIPTION OF THE PREFERRED EMBODIMENTS

In a first preferred embodiment of the present invention, a light duty lubricant composition with enhanced penetration and spreadability is provided comprising a hydrocarbon solvent, a volatile silicone fluid, and a lubricating oil soluble in the hydrocarbon solvent. In a second preferred embodiment, the composition of the present invention further includes a corrosion inhibitor. In another preferred embodiment, the light duty lubricant composition comprising a hydrocarbon solvent, a volatile silicone, a lubricating oil and a corrosion inhibitor is blended with an aerosol propellant. Another preferred embodiment includes a method for freeing frozen or corroded parts with a light duty lubricant composition.

The hydrocarbon solvent useful in the present invention is any hydrocarbon solvent that has a viscosity of less than about 10 cPs. at 25'C., has a low odor, a moderate flash point and evaporates quickly. Preferably, the hydrocarbon solvent is selected from the group consisting of aliphatics, olefinics, isoparaffinics, cycloparaffinics, normal paraffinics, aromatics and mixtures thereof. More preferably, a hydrocarbon solvent that has a flash point above 40'C. is used and is selected from the group consisting of aliphatics, olefinics, isoparaffinics, cycloparaffinics, normal paraffinics and mixtures thereof. Most preferred are hydrocarbon solvents selected from the group consisting of mineral spirits having a distillation range of 175–200'C., a specific gravity at 25'C. of 0.75–0.76, a flash point of from about 50'C. to about 55'C., a viscosity at 25'C. of 1.4 cPs. with a carbon chain of from about 10 to about 13. Exemplary of the most preferred hydrocarbon solvent is mineral spirits sold under the trade names SHELL SOL 71 by Shell Chemical Company and ISOPAR K by Exxon Chemical Corporation.

The hydrocarbon solvent, which is most preferably mineral spirits, constitutes a major amount of the light duty lubricant composition and is preferably present in the range of from about 30% to about 97% by weight of the total composition. More preferably, the hydrocarbon solvent is present in the range of from about 46% to about 85% by weight of the total composition, and most preferably the hydrocarbon solvent is present in a range of from about 62% to about 78% by weight of the total composition, with 69% to about 73% being optimal.

Volatile silicone fluids generally are low viscosity silicone fluids with an appreciable vapor pressure at ambient temperatures. Generally, the volatile silicone fluids useful in the present invention have a viscosity of less than about 10 cSt. at 25'C. Preferred volatile silicone fluids include the polydimethylcyclosiloxanes with a specific gravity at 25'C. of 0.95–0.96 and a viscosity from about 4–8 cSt. at 25'C.

Polydimethylcyclosiloxane fluids useful in the present invention can be defined by the general formula $[(CH_3)_2SiO]_x$ where x has a value from 3 to 8. Generally, the polydimethylcyclosiloxane fluid useful in the present invention is a mixture of one or more of the various species represented by the above formula. The commercial polydimethylcyclosiloxanes are mixtures of the various species represented by the above formula and are considered within the scope of the present invention.

The preferred polydimethylcyclosiloxane fluids for use in this invention are those where octamethylcyclotetrasiloxane, decamethylcyclopentasiloxane and dodecamethylcyclohexasiloxane (i.e., where x is from 4 to 6) predominate. The fluids where decamethylcyclopentasiloxane and dodecamethylcyclohexasiloxane predominate are particularly preferred. In accordance with the most preferred embodiment, those volatile silicone fluids manufactured by Dow Corning Corporation under the trade name DOW CORNING® 245 FLUID and DOW CORNING® 345 FLUID are used. It is believed that DOW CORNING® 245 FLUID consists of about 95% decamethylcyclopentasiloxane and DOW CORNING® 345 FLUID consists of about 75% of a mixture of octamethylcyclohexasiloxane and decamethylcyclopentasiloxane and about 25% dodecamethylcyclohexasiloxane.

Preferably, the volatile silicone fluid comprises from about 1% to about 30% by weight of the light duty lubricant composition and more preferably, from about 2% to about 20% by weight of the light duty lubricant composition. Most preferably, the volatile silicone fluid is present in the range of from about 3% to about 10% by weight of the light duty lubricant composition with from about 4% to about 6% by weight being optimal.

The light duty lubricant composition of the present invention further includes a lubricating oil comprising any fluid soluble in a hydrocarbon base selected from the group consisting of hydrocarbon oils; fatty petroleum alcohols, esters, amines and amides, sulfides, thiols, carboxylates and phosphates; silicones and mixtures thereof. Preferably, the lubricating oil used is selected from the group consisting of hydrocarbon oils and mixtures thereof and more preferably the lubricating oil is selected from the group of hydrocarbon oils with a low odor and light color. Most preferably, the lubricating oil is a mineral oil with the general formula $C_nH_{(2n+2)}$, a low odor, a light color, a specific gravity of 0.83–0.85 and a viscosity of 15–20 cPs. at 25'C. Exemplary of the mineral oils most preferred in the composition of the present invention are those sold by Penreco Corporation under the trade name PAROL 70 and by Witco Chemical Company under the trade name SEMTOL 70.

Preferably, the lubricating oil, which is most preferably mineral oil, is present in a range of from about 1% to about 30% by weight of the total composition and more preferably is present in a range of from about 10% to about 25% by weight of the light duty lubricant composition. Most preferably, the lubricating oil is present in a range of from about 15% to about 20% by weight of the composition with about 17% to about 19% being optimal.

In a second embodiment of the light duty lubricant composition of the present invention, the composition further includes a corrosion inhibitor which is soluble in a hydrocarbon base such as fatty or petroleum oxidates including carboxylates, esters, aldehydes and ketones; fatty amines, amides, sulfides, sulfonates and phosphates; and functional silicones such as amine and amine-alkoxy functional resins. More preferably, the corrosion inhibitor of the present invention comprises petroleum oxidates which provide a waxy film when applied from a hydrocarbon solvent system and mixtures thereof, and most preferably petroleum oxidates having an acid value (mg KOH/g) equal to 15–25, a melting point of 32–42'C., a saponification value (mg KOH/g) equal to 50–67, a specific gravity at 15.6'C. of 0.96–0.98 and a flash point of about 177'C. Exemplary of the most preferred petroleum oxidate is that sold under the trade name ALOX® 2213C, a proprietary composition by Alox Corporation which is believed to contain about 0.1% calcium and 1.1% sodium.

The corrosion inhibitor, most preferably petroleum oxidates, is preferably present in the light duty lubricant composition of the present invention in a range from about 1% to about 10% by weight of the total composition, and more preferably in a range of from about 3% to about 9% by weight of the total composition. Most preferably, the corrosion inhibitor is present in a range from about 4% to about 8% by weight of the total composition with about 5% to about 7% being optimal.

In another embodiment of the present invention, the light duty lubricant composition which comprises a hydrocarbon solvent, volatile silicone fluid, a lubricating oil, and optionally a corrosion inhibitor is blended with an aerosol propellant wherein the light duty lubricant composition is present in a range of from about 50% to about 99% by weight of the total composition and the aerosol propellant is present in a range from about 1% to about 50% by weight of the total composition. More preferably, the light duty lubricant composition is present in an amount of from about 70% to about 90% by weight of the total composition and the aerosol propellant is present in the amount of from about 10% to about 30% by weight of the total composition. Most preferably, in this embodiment of the composition of the present invention, the light duty lubricant composition is present in an amount of from about 75% to about 85% by weight of the total composition and the aerosol propellant is present in an amount of from about 15% to about 25% by weight of the total composition with the light duty lubricant composition being optimally present in an amount of from between 79% to 81% and the aerosol propellant being present in the amount of from about 19% to about 21% of the total composition.

In an additional embodiment of the present invention, a method of freeing frozen or corroded parts is disclosed comprising the steps of applying the light duty lubricant composition to the frozen or corroded part by spraying, rolling or brushing the light duty lubricant composition onto the frozen or corroded part, or dipping the frozen or corroded part into the lubricant composition; waiting a sufficient period of time of from approximately 1 to approximately 5 minutes for the light duty lubricant composition to seep into the channels on the frozen or corroded part; and applying the appropriate force through sliding, rotating or torquing the frozen or corroded part to produce turning, sliding or separation of the frozen or corroded part.

The light duty lubricant composition of the present invention is manufactured through standard manufacturing processes such as mixing or blending the composition and is typically prepared through the sequential addition of ingredients to a mixing vessel with moderate shear mixing provided by a turbine, propeller, impeller or the like with the order of addition and temperature suitable to the specific ingredients chosen. In one embodiment, the hydrocarbon solvent is first added to the mix vessel and, thereafter, the volatile silicone and lubricating oil are added. Optionally, a corrosion inhibitor may then be added. The light duty lubricant composition is thereafter agitated to mix. In another embodiment, the light duty lubricant composition is first mixed through the above process and thereafter blended with an aerosol propellant through the typical aerosol manufacturing process which are known in the art.

The light duty lubricant composition can be used for a variety of purposes such as preventative lubrication, rust inhibition, lubrication of frozen or corroded metal parts and others.

EXAMPLE SECTION

The following examples are provided by way of explanation and description and should not be seen as limiting the scope of the invention.

In the examples that follow, the ingredients used have the following descriptions:

| | |
|---|---|
| Mineral Spirits - | Mineral spirits sold under the trade name SHELL SOL 71 by Shell Chemical Company. |
| High-Flash - Aliphatic Solvent | High-flash aliphatic hydrocarbon solvent sold under the trade name EXXSOL D-110 by Exxon Chemical Corporation. |
| Toluene - | Industrial grade toluene sold by Exxon Chemical Corporation. |
| Volatile - Silicone Fluid | A blend of polydimethylcyclosiloxanes sold under the trade name DOW CORNING ® 345 FLUID by Dow Chemical company. |
| Mineral oil - | Technical grade mineral oil sold by Penreco Corporation under the trade name PAROL 70. |
| Polydimethyl- - siloxane | Polydimethylsiloxane sold under the trade name DOW CORNING ® 200 FLUID, 350 cSt. viscosity grade. |
| Calcium/Sodium - Petroleum Oxidates | Calcium/sodium petroleum oxidates sold under the trade name ALOX ® 2213C, a proprietary composition, by Alox Corporation. |
| Barium - Petroleum Oxidates | Barium petroleum oxidates sold under the trade name ALOX ® 2028 by Alox Corporation. |
| Organic Amine - Phosphate | organic amine phosphate sold under the trade name MONACOR TEH by Mona Industries, Inc. |

The following liquid compositions 1–12 were prepared by mixing the following components in a standard mixing vessel at 40'C. in the order identified in the manufacturing process.

TABLE 1

| | Composition (weight percent) | | | | | | | | | | | |
|---|---|---|---|---|---|---|---|---|---|---|---|---|
| COMPONENTS | 1 | 2 | 3 | 4 | 5 | 6 | 7 | 8 | 9 | 10 | 11 | 12 |
| Mineral Spirits | 71.0 | | | 76.0 | | | 71.0 | 76.0 | 71.0 | 76.0 | 71.0 | 76.0 |
| High-Flash Aliphatic Solvent | | 71.0 | | | 76.0 | | | | | | | |
| Toluene | | | 71.0 | | | 76.0 | | | | | | |
| Volatile Silicone Fluid | 5.0 | 5.0 | 5.0 | | | | 5.0 | | 5.0 | | 5.0 | |
| Mineral Oil | 18.0 | 18.0 | 18.0 | 18.0 | 18.0 | 18.0 | 18.0 | 18.0 | | | 18.0 | 18.0 |
| Polydimethylsiloxane | | | | | | | | | 18.0 | 18.0 | | |
| Calcium/Sodium Petroleum Oxidate | 6.0 | 6.0 | 6.0 | 6.0 | 6.0 | 6.0 | | | | | | |
| Barium Petroleum Oxidate | | | | | | | | | | | 6.0 | 6.0 |
| Organic Amine Phosphate | | | | | | | 6.0 | 6.0 | 6.0 | 6.0 | | |

Composition 1 exemplifies the most preferred embodiment of the compositions of the present invention. The above example formulas were evaluated for their relative ability to spread over a metal surface. Several drops of each of two formulas were placed about 2–3 cm apart on a polished aluminum panel and were allowed to spread until the drops met. The formula which would spread further after meeting the other formula demonstrated superior relative spreading and displacement performance. In every comparison, formulas containing a volatile silicone fluid displaced the analogous formula without this component. The following comparisons were made: Example 1 displaced 4, 2 displaced 5, 3 displaced 6, 7 displaced 8, 9 displaced 10 and 11 displaced 12. These results show the consistent ability of volatile silicone fluid to improve the spreading and displacing properties of a variety of light duty lubricant formulas.

It should be understood that a wide range of changes, modifications, and equivalents could be made to the embodiments described above. It is therefore intended that the above descriptions illustrate, rather than limit, the invention and that it is the following claims, including all equivalents, which define the compositions and methods of use of the compositions of the present invention.

What is claimed is:

1. A light duty lubricant composition with enhanced penetration and spreadability comprising:

from about 30% to about 97% by weight of a hydrocarbon solvent;

from about 1% to about 30% by weight of a volatile silicone, wherein the volatile silicone has a viscosity of less than about 10 cst. at 25° C.

2. The light duty lubricant composition of claim 1 further comprising from about 1% to about 10% by weight of a corrosion inhibitor soluble in a hydrocarbon base selected from the group consisting of fatty or petroleum oxidates and mixtures thereof.

3. A light duty lubricant composition with enhanced penetration and spreadability comprising:

from about 30% to about 97% by weight of a hydrocarbon solvent with a flash point over 40° C., a viscosity of less than about 10 cPs. at 25° C. selected from the group consisting of aliphatics, olefinics, isoparraffinics, cycloparaffinics, normal paraffinics and mixtures thereof;

from about 1% to about 30% of a volatile silicone selected from the group consisting of polydimethylcyclosiloxanes and mixtures thereof, wherein the volatile silicone has a viscosity of less than about 10 cst. at 25° C.;

from about 1% to about 30% by weight of a lubricating oil soluble in a hydrocarbon base selected from the group consisting of hydrocarbon oils and mixtures thereof; and from about 1% to about 10% by weight of a corrosion inhibitor soluble in a hydrocarbon base selected from the group consisting of fatty or petroleum oxidates and mixtures thereof.

4. The light duty lubricant composition of claim 3 wherein the hydrocarbon solvent is mineral spirits having a viscosity of 1.4 cPs. at 25° C. and a carbon chain of from about 10 to about 13.

5. The light duty lubricant composition of claim 4 wherein the hydrocarbon solvent is present in a range of from about 46% to about 85% by weight.

6. The light duty lubricant composition of claim 4 wherein the hydrocarbon solvent is present in a range of from about 62% to about 78% by weight.

7. The light duty lubricant composition of claim 3 wherein the volatile silicone is selected from the group consisting of octamethylcyclotetrasiloxane, decamethylcyclopentasiloxane, dodecamethylcyclohexasiloxane and mixtures thereof.

8. The light duty lubricant composition of claim 3 wherein the volatile silicone is present in a range of from about 2% to about 20% by weight.

9. The light duty lubricant composition of claim 3 wherein the volatile silicone is present in a range of from about 3% to about 10% by weight.

10. The light duty lubricant composition of claim 3 wherein the lubricating oil has a viscosity of from about 15 to about 20 cPs. at 25'C.

11. The light duty lubricant composition of claim 10 wherein the lubricating oil is mineral oil.

12. The light duty lubricant composition of claim 3 wherein the lubricating oil is present in a range of from about 10% to about 25% by weight.

13. The light duty lubricant composition of claim 3 wherein the lubricating oil is present in a range of from about 15% to about 20% by weight.

14. The light duty lubricant composition of claim 3 wherein the fatty or petroleum oxidate is selected from the group consisting of carboxylates, esters, aldehydes, ketones and mixtures thereof.

15. The light duty lubricant composition of claim 3 wherein the fatty or petroleum oxidate is present in a range of from about 3% to about 9% by weight.

16. The light duty lubricant composition of claim 3 wherein the fatty or petroleum oxidate is a petroleum oxidate with an acid value (mg KOH/g) of from about 15 to about 25 and a saponification value (mg KOH/g) of from about 50 to about 67.

17. A light duty lubricant composition with enhanced penetration and spreadability comprising:

from about 46% to about 85% by weight of mineral spirits with a viscosity at 25° C. of 1.4 cPs., a flash point of about 50°–55° C. and a carbon chain of from about 10 to about 13;

from about 2% to about 20% by weight of a volatile silicone selected from the group consisting of octamethylcyclotetrasiloxanes, decamethylcyclopentasiloxanes, dodecamethylcyclohexasiloxanes, and mixtures thereof, wherein the volatile silicone has a viscosity of less than about 10 cst. at 25° C.;

from about 10% to about 25% by weight of mineral oil with a viscosity of from about 15 to about 20 cPs. at 25° C.; and from about 3% to about 9% by weight of a petroleum oxidate containing about 0.1% calcium and about 1.1% sodium.

18. An aerosol propelled light duty lubricant composition with enhanced penetration and spreadability comprising:

(a) from about 50% to about 99% by weight of the total composition of a light duty lubricant concentrate comprising;

(i) from about 46% to about 85% by weight of said lubricant concentrate of mineral spirits with a viscosity at 25° C. of 1.4 cPs., a flash point of about 50°–55° C. and a carbon chain of from about 10 to about 13;

(ii) from about 2% to about 20% by weight of said lubricant concentrate of a volatile silicone selected from the group consisting of octamethylcyclotetrasiloxanes, decamethylcyclopentasiloxanes, dodecamethylcyclohexasiloxanes, and mixtures thereof, wherein the volatile silicone has a viscosity of less than about 10 cst. at 25° C.;

(iii) from about 10% to about 25% by weight of said lubricant concentrate of mineral oil with a viscosity of from about 15 to about 20 cPs. at 25° C.;

(iv) from about 3% to about 9% by weight of said concentrate of a petroleum oxidate containing about 0.1% calcium and about 1.1% sodium; and (b) from about 1% to about 50% by weight of the total composition of an aerosol propellant selected from the group consisting of liquified hydrocarbon gases, carbon dioxide, nitrous oxides, nitrogen, dimethyl ether, fluorocarbons and mixtures thereof.

19. A method of freeing frozen or corroded parts comprising the steps of:

(a) applying a light duty lubricant composition by spraying, brushing, rolling or dipping onto corroded parts, said composition comprising:

(i) from about 46% to about 85% by weight of mineral spirits with a viscosity at 25° C. of 1.4 cPs., a flash point of about 50°–55° C. and a carbon chain of from about 10 to about 13;

(ii) from about 2% to about 20% by weight of a volatile silicone selected from the group consisting of octamethylcyclotetrasiloxanes, decamethylcyclopentasiloxanes, dodecamethylcyclohexasiloxanes, and mixtures thereof, wherein the volatile silicone has a viscosity of less than about 10 cst. at 25° C.;

(iii) from about 10% to about 25% by weight of mineral oil with a viscosity of from about 15 to about 20 cPs. at 25° C.;

(iv) from about 3% to about 9% of a petroleum oxidate containing about 0.1% calcium and about 1.1% sodium;

(b) waiting for 1 to 5 minutes; and (c) applying appropriate force through sliding, rotating or torque to the frozen or corroded part to produce turning, sliding or separation of the part.

20. A method of freeing frozen or corroded parts comprising the steps of:

(a) applying a light duty lubricant composition by spraying, brushing, rolling or dipping onto corroded parts, said composition comprising:

(i) from about 46% to about 85% by weight of mineral spirits with a viscosity at 25'C. of 1.4 cPs., a flash point of about 50–55'C. and a carbon chain of from about 10 to about 13;

(ii) from about 2% to about 20% by weight of a volatile silicone selected from the group consisting of octamethylcyclotetrasiloxanes, decamethylcyclopentasiloxanes, dodecamethylcyclohexasiloxanes and mixtures thereof;

(iii) from about 10% to about 25% by weight of mineral oil with a viscosity of from about 15 to about 20 cPs. at 25'C.;

(iv) from about 3% to about 9% of a petroleum oxidate containing about 0.1% calcium and about 1.1% sodium;

(b) waiting for 1 to 5 minutes; and (c) applying appropriate force through sliding, rotating or torque to the frozen or corroded part to produce turning, sliding or separation of the part.

* * * * *